United States Patent [19]

Mattei

[11] Patent Number: 4,497,143

[45] Date of Patent: Feb. 5, 1985

[54] DEVICE FOR SHARPENING ROTATING BLADES

[75] Inventor: Riccardo Mattei, Bologna, Italy

[73] Assignee: G. D Societa' per Azioni, Bologna, Italy

[21] Appl. No.: 511,987

[22] Filed: Jul. 8, 1983

[30] Foreign Application Priority Data

Jul. 14, 1982 [IT] Italy ..... 3484 A/82

[51] Int. Cl.[3] ..... B24B 3/36

[52] U.S. Cl. ..... 51/248; 83/174.1

[58] Field of Search ..... 51/247, 248, 246; 83/174, 174.1

[56] References Cited

U.S. PATENT DOCUMENTS 2,978,848 4/1961 Raine ..... 51/247

4,065,880 1/1978 Maw ..... 51/247

FOREIGN PATENT DOCUMENTS 276470 9/1927 United Kingdom ..... 51/24

*Primary Examiner*—Roscoe V. Parker

*Attorney, Agent, or Firm*—Marshall, O'Toole, Gerstein, Murray & Bicknell

[57] ABSTRACT

A device for sharpening rotating blades, in which a transverse approaching movement of a grindstone-carrying shaft towards an associated rotating blade to be sharpened is controlled, within a predetermined range, by a sensor sensitive to the speed of rotation imparted by friction to the said shaft by the associated blade.

7 Claims, 5 Drawing Figures

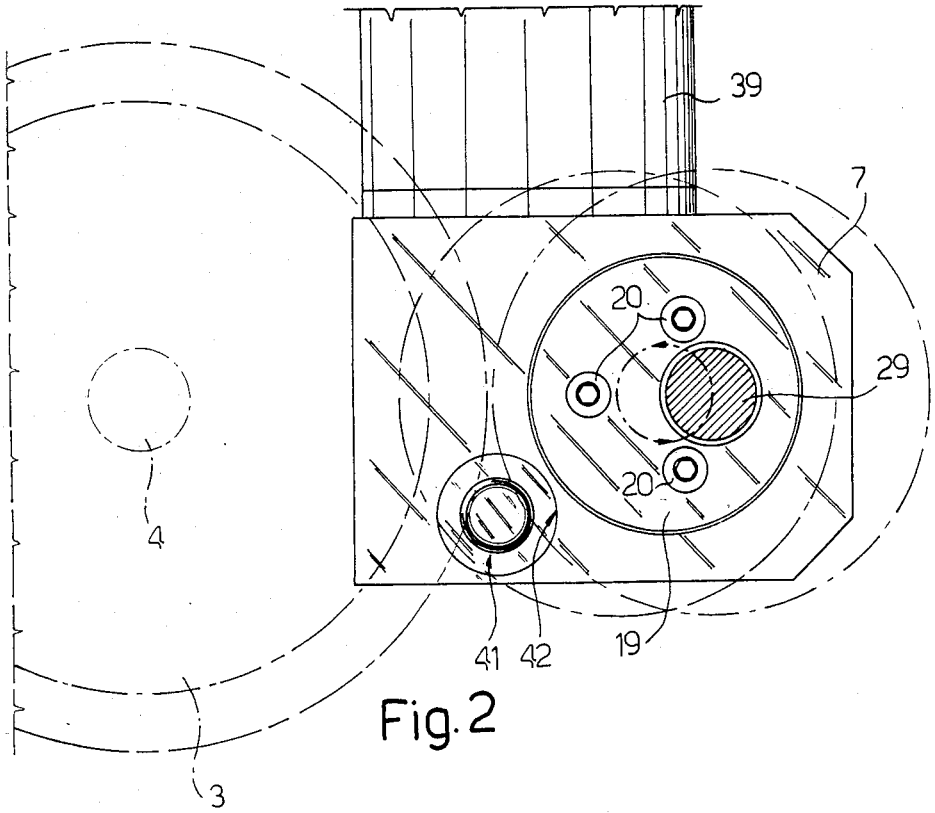
Fig. 2
Fig. 4
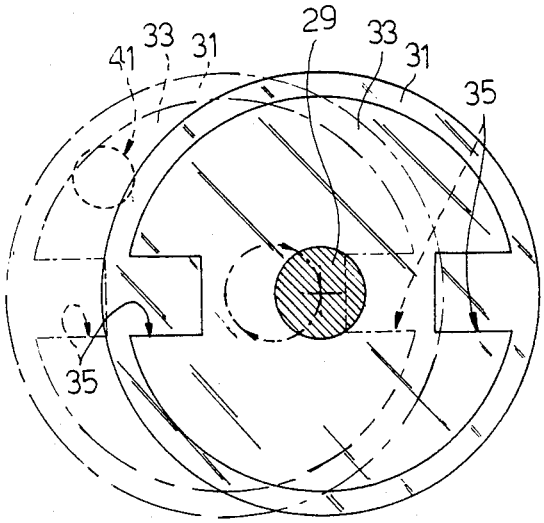

DEVICE FOR SHARPENING ROTATING BLADES

BACKGROUND OF THE INVENTION

The present invention relates to a device for sharpening rotating blades.

The device in question can be used for sharpening any type of rotating blades, both of the disc type and of the so-called "hook blade" type having blades projecting radially from a rotating hub.

The present invention finds particularly advantageous application in the field of filter cigarette making machines in that such machines utilize rotating blades both for cutting the rods of cigarette and for cutting the filters.

In cigarette making machines, and in particular in filter fitting machines, to which the following description will make exclusive reference without any loss of generality thereby, it is known to utilize rotating blades constituted by disc knives the outer periphery of which is normally able to rotate within the space lying between two grindstones keyed onto a shaft forming a predetermined angle with the axis of the associated knife. For the purpose of compensating the reduction in the radius of the said knife due to wear, the shaft supporting the grindstone is normally mounted on a slide movable in a direction transverse the shaft itself under the action of a transmission manually actuated by an operator, or else incrementally by a motor.

In the case in which the position of the said slide is controlled manually, the relationship between the periphery of the knife and the associated grindstone is not always correct and this gives rise either to a perfect sharpening obtained with an excessive removal of material or else to an insufficient sharpening. This latter disadvantage is normally obviated by incremental motorised control in that it is normal to adjust the drive motor in such a way that the removal of material is always in excess. In this way, however, wear on the knife is always more rapid than necessary.

SUMMARY OF THE INVENTION

The object of the present invention is to provide a sharpening device which permits the above described disadvantages to be avoided by adjusting the sharpening of the blades automatically as a function of their effective wear.

The said object is achieved by the present invention in that it relates to a sharpening device for rotating blades, comprising at least one grindstone keyed onto a shaft rotatable about an axis inclined with respect to an axis of rotation of an associated said driven rotating blade, the periphery of this latter being able to come into contact with each said grindstone to cause the said shaft to rotate by frictional contact; a movable support for the said shaft, and actuator means for displacing the said movable support to vary the relative position of the said blade and each said grindstone, characterised by the fact that it includes first control means sensitive to the speed of rotation of the said shaft, connected to the said actuator means to maintain the said speed above a predetermined value, and second control means for maintaining, in use, the distance between the said axes within a predetermined range of values.

BRIEF DESCRIPTION OF THE DRAWINGS

Further characteristics and advantages of the present invention will become apparent from the following description with reference to the attached drawings, which illustrate a non limitative embodiment thereof, in which:

FIG. 2 is a plan view of the device of FIG. 1;

FIG. 4 is a plan view of a first detail of the preceding Figures; and

DETAILED DESCRIPTION OF THE INVENTION

Figure 1:
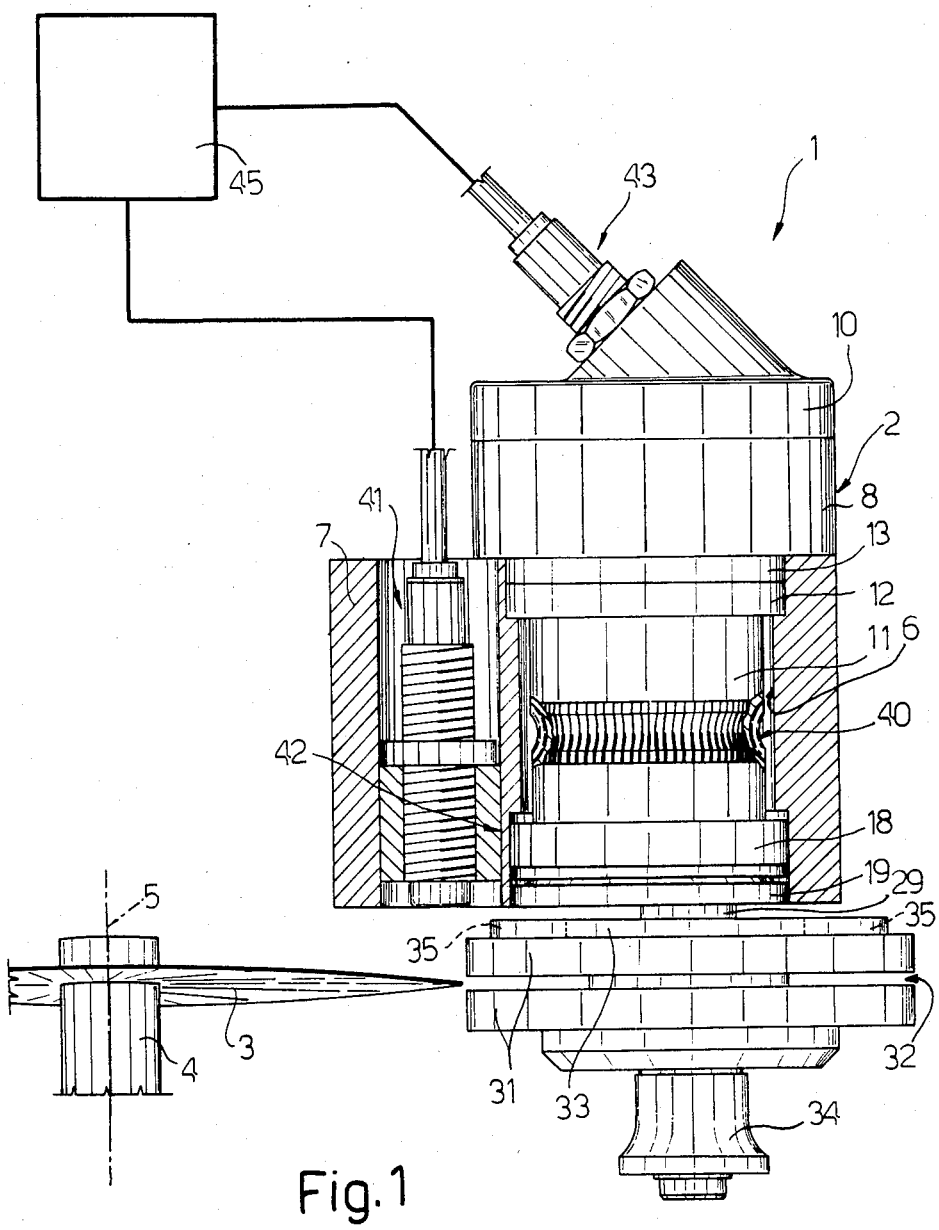
FIG. 1 is a side view, with parts in section and parts removed for clarity, of a sharpening device formed according to the principles of the present invention.
Figure 3:
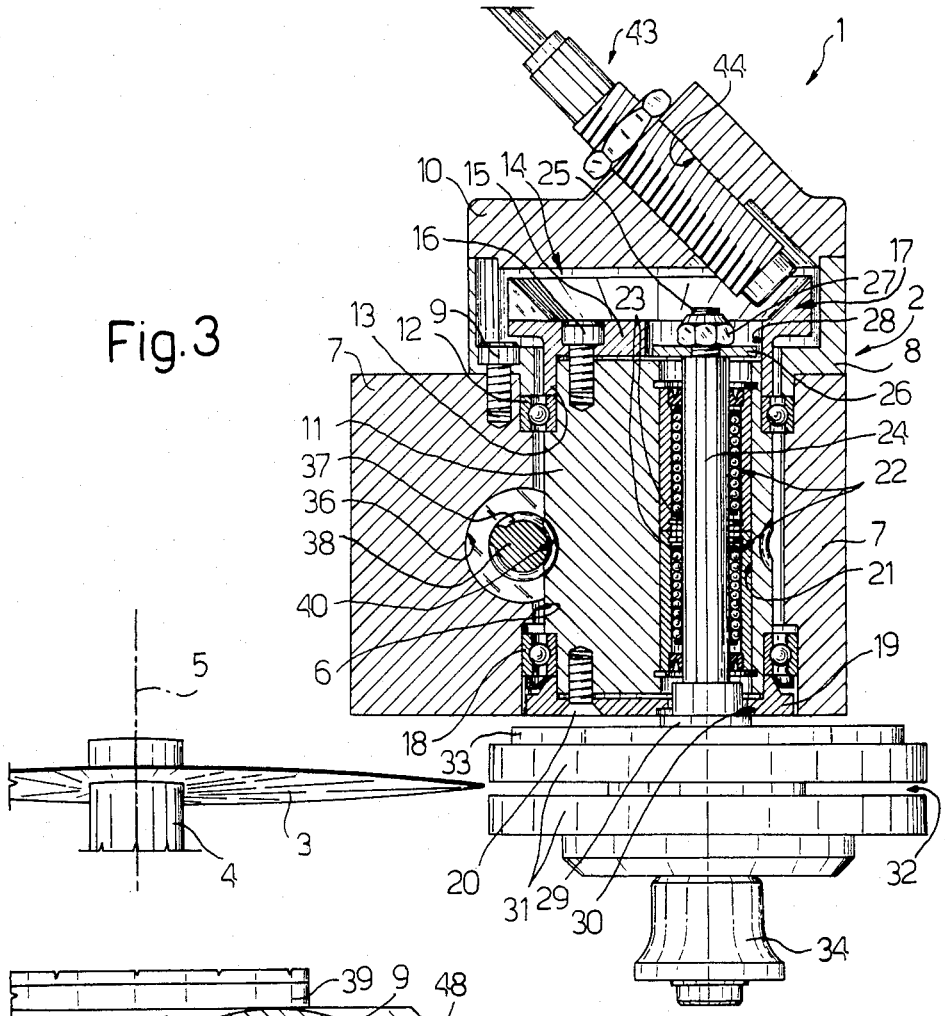
FIG. 3 illustrates the device of the FIGS. 1 and 2 partially in axial section.

In FIGS. 1 and 2 and, in particular in FIG. 3, there is shown a sharpening device generally indicated 1 and comprising an outer supporting casing 2 rigidly connected to a fixed wall (not illustrated) of a filter fitting machine (not illustrated). This latter includes at least one rotating knife 3 keyed onto a driven shaft 4 the axis 5 of which is inclined, in particular skew, with respect to an axis of an axial hole 6 formed through the casing 2.

The casing 2 includes a central body 7 of prismatic form, traversed by the hole 6 and rigidly connectable by means not illustrated to the said filter fitting machine. One end of the hole 6 is closed by means of an annular body 8 fixed to the central body 7 by screws 9, and a substantially circular cover 10 rigidly connected to the end of the annular body 8 opposite that connected to the central body 7. Within the hole 6 is rotatably housed a movable support or cylindrical body 11 a first end of which facing the cover 10 is coupled to the inner surface of the hole 6 by means of a first bearing 12. The outer ring of bearing 12 is axially fixed on the body 7 by means of the annular body 8, whilst the inner ring thereof is axially fixed on the body 11 by tubular projection 13 of a cup-shape body 14. The cup-shaped body 14 includes a bottom wall 15 facing an end surface of the body 11 and rigidly connected thereto by means of screws 16, and a side wall 17 facing the cover 10. The other end of the cylindrical body 11 is connected to the inner surface of the hole 6 by means of a second bearing 18 the outer ring of which is slidably coupled to the body 7 and the inner ring of which is axially fixed on the body 11 by means of a plate 19 rigidly connected to the associated end of the body 11 by means of screws 20.

Through the body 11 there is formed an eccentric axial through hole 21 coaxially within which are force fitted the outer sleeves of two ball bearing sleeves 22, in which the balls are supported by cages 23 axially slidable with respect to the associated outer "sleeves" to permit the axially slidable and rotatable support of a shaft 24.

The shaft 24 has at its end facing the cover 10 a threaded projection 25 extending through a washer 26 fixed to the end of the shaft 24 itself by means of a nut 27 and axially slidable within a hole 28 formed in the wall 15. The shaft 24 is further provided with a flange 29 mounted slidably within a through hole 30 of the plate 19 and constituting, with the washer 26, a stop means or axial stroke limiter of the shaft 24 with respect to the body 11.

The end of the shaft 24 opposite that facing the cover 10 projects from the bodies 7 and 11 and supports two disc grindstones 31 keyed in facing positions and defining between them an annular space 32 which can be engaged, in use, by the periphery of the knife 3.

In a variant not illustrated the knife 3 has, in section, a form such as to require the sharpening of only one side, in which case the shaft 24 supports a single grindstone 31.

This shaft 24 carries keyed thereto a circular or disc-like body 33 disposed between the grindstone 31 and the flange 29 and axially fixed on the shaft 24 itself together with the grindstones 31, by means of a terminal ring nut 34. As illustrated in FIG. 4, the disc 33 has a substantially circular form and is provided along its outer periphery with two recesses or notches 35 disposed in diametrically opposite positions with respect to one another. In a variant not illustrated the disc 33 has a single recess 35 or else at least three recesses 35 uniformly distributed around its periphery.

Through the body 7 there is formed a through hole 36 perpendicular to the hole 6 and communicating with this latter for a certain length. The hole 36 rotatably houses a worm screw 37 supported by an output shaft 38 of actuator means constituted by an electric stepping motor 39 the housing of which is rigidly connected to the body 7. The worm screw 37 is coupled to a toothed ring 40 formed on the outer surface of the body 11 to carry this latter into rotatation about its axis.

The operation of the motor 39 is regulated by two sensors or control means the first of which, indicated 41, is housed within a hole 42 formed through the body 7 in a position parallel to and facing the hole 6, whilst the second, indicated 43, is supported by the cover 10 and extends through an oblique hole 44 therein.

The sensor 41 is a capacitive sensor disposed with its detecting end facing the disc 33 and able to cooperate with this latter in a manner which will be described below, to send a train of impulses the frequency of which is proportional to the angular velocity of the shaft 24 to a control unit 45 for the motor 39.

The sensor 43 is also of the capacitive type, and is disposed with its detecting end facing an inner oblique surface of the wall 17 of the cup-shape body 14. The sensor 43 cooperates, in a manner which will be described below, with the grooves 46 and 47 formed in the wall 17 to send to the control unit 45 singals which vary accordingly as the detecting end is located facing one of the grooves 46 and 47 or one of the projections 48 and 49 defined on the wall 17 of the grooves 46 and 47.

The operation of the device 1 will now be described starting from the condition it is in upon starting the filter fitting machine after the replacement of a knife 3 (see FIGS. 1 and 3).

In the start-up condition mentioned above, the detecting end of the sensor 43 is located facing the groove 46 in a position in which the signals therefrom sent to the control unit 45 maintain the motor 39 in a stopped condition whilst the grindstone 31 is spaced the maximum distance from the knife 3 the outer periphery of which is disposed outside the annular space 32.

Figure 5:
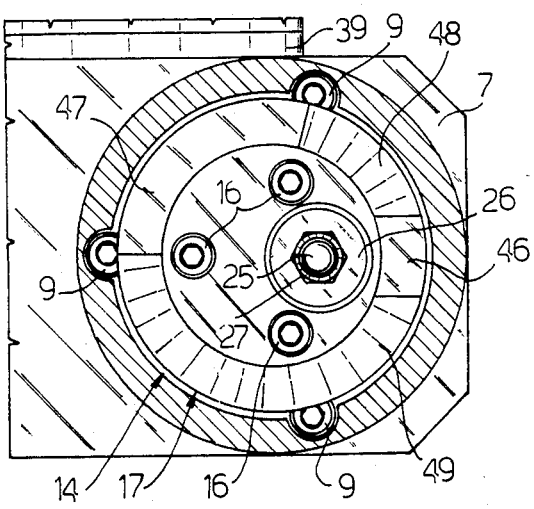
FIG. 5 is a plan view of a second detail of FIGS. 1 to 3.

Starting the filter fitting machine causes, by means not illustrated, the temporary blocking of the sensor 43 and starting of the motor 39 which causes rotation of the bodies 11 and 14 in clockwise direction as seen in FIG. 5, and displacement of the projections 48 in front of the sensor 43. This latter is in this way reactivated and emits signals which maintain the motor 39 in rotation until the groove 47 comes in front of the detecting end of the sensor 43. Detection by the sensor 43 of the groove 47 causes it to switch out and activate the sensor 41 under the control of which the motor 39 will remain for the whole of the time in which the sensor 43 faces this groove 47.

Given the eccentricity of the shaft 24 with respect to the body 11, the above described rotation of this latter corresponds to an approaching movement of the grindstone 31 to the knife 3, which when the groove 47 is present in front of the sensor 43 engages with its peripheral edge in the annular space 32 and, given the inclination of its axis 5 with respect to the axes of the grindstones 31, comes into contact with both these latter. Since the shaft 4 of the knife 3 is driven the contact between the knife 3 and the grindstones 31 causes these to rotate by friction about their axes with a speed which is variable in dependence on the contact pressure between the knife 3 and the grindstones 31.

Further to what has been described above it is appropriate to observe that the contact pressures between the opposite edges of the knife 3 and the grindstones 31 remain equal during sharpening because of the presence of the ball sleeves 22 which, by permitting axial sliding of the shaft 24 with respect to the body 11, allow the grindstones 31 automatically to move to a perfect equilibrium position as far as the sharpening pressures are concerned.

Rotation of the grindstones 31 correspond to rotation of the disc 33 which, by being displaced in front of the sensor 41 causes, upon passage of its recesses 35 the emission by the sensor 41 of a train of pulses the frequency of which is a function of the angular velocity of the grindstones 31. The control unit 45 is programmed in such a way as to cause activation of the motor 39 for the whole of the time that the said frequency falls below a predetermined value. Consequently, when the pressure between the knife 3 and the grindstones 31 falls, following wear of the knife 3 and the grindstones 31 causing consequent reduction in the angular velocity of the latter, the control unit 45 activates the motor 39 which displaces the grindstones 31 towards the knife 3 until the correct contact pressure is regained and, consequently, correct sharpening of the blade 3 is obtained.

Obviously, continuous sharpening of the knife 3, obtained by rotation of the body 11 with respect to the body 7, causes progressive wear of the knife 3 until its radial dimensions fall below a minimum determined value corresponding to the positioning in front of the detecting end of the sensor 43 of the end of the projection 49 and a minimum distance situation between the grindstone 31 and the axis 5 of the knife 3.

When this above-described situtation occurs the sensor 43 excludes the sensor 41 and causes advancement of the motor 39 until the presence of the groove 46 in front of its detecting end is detected. Transfer from the projection 49 to the groove 46 causes the sensor 43 to emit a machine stop signal to permit replacement of the knife 3 in conditions of maximum separation of this latter from the grindstones 31.

I claim:

1. A device for sharpening rotating blades, comprising at least one grindstone (31) keyed onto a shaft (24) rotatable about its axis inclined with respect to an axis (5) of rotation of an associated said driven rotating blade (3), the periphery of this latter being able to come into contact with each said grindstone (31) to carry the said shaft (24) into rotation by friction; a movable support (11) for the said shaft (24), and actuator means (39) to displace the said movable support (11) for the purpose of varying the relative position of the said blade (3) and each said grindstone (31), characterised by the fact that it includes first control means (41) sensitive to the speed of rotation of the said shaft (24), connected to the said actuator means (39) to maintain the said speed above a predetermined value, and second control means (43) for maintaining, in use, the distance between the said axes (5,24) within a predetermined range of values.

2. A device according to claim 1, characterised by the fact that it includes two said grindstones (31) keyed onto the said shaft (24) in positions facing one another and defining between them an annular space (32) which can be entered by the periphery of the said blade (3); the said shaft (24) being mounted on the said movable support (11) in a rotatable and axially slidable manner.

3. A device according to claim 2, characterised by the fact that the said shaft (24) is coupled to the said movable support (11) by means of slidable ball bearing sleeves (22) of the type having cages (23); means (26–29) being provided to limit the axial excursion of the said shaft (24) with respect to the said movable support (11) within a predetermined range.

4. A device according to claim 1, characterised by the fact that the said movable support is constituted by a body (11) mounted on a fixed support (2) to rotate with respect thereto about its axis parallel to the said shaft (24); this latter extending through an eccentric axial hole (21) in the said movable support (11).

5. A device according to claim 4, characterised by the fact that the said actuator means include a motor (39) supported by the said fixed support (2) and connected to the said movable support (11) by means of a worm screw and worm wheel coupling (37–40).

6. A device according to claim 1, characterised by the fact that the said first control means include a capacitive sensor (41) supported in a fixed position and disposed with its detecting end facing a circular body (33) provided with at least one peripheral notch (35) and keyed on the said shaft (24).

7. A device according to claim 4, characterised by the fact that the said second control means include a second capacitive sensor (43) supported in a fixed position by the said fixed support (2) and disposed with its detecting end facing a shaped end (14) of the said movable support (11), for emitting start and stop signals for the said actuator means (39) in dependence on the angular position assumed by the said movable support (11) with respect to the said fixed support (2).

* * * * *